United States Patent [19]

Fujii et al.

[11] 4,248,974

[45] Feb. 3, 1981

[54] BINDER COMPOSITION FOR FOUNDRY SAND CONTAINING ZINC CARBONATE DISPERSED IN RESIN

[75] Inventors: Shin Fujii, Zama; Koue Ohkawa, Yokohama; Takashi Seino, Yokosuka, all of Japan

[73] Assignee: Nissan Motor Company, Limited, Yokohama, Japan

[21] Appl. No.: 46,308

[22] Filed: Jun. 7, 1979

[30] Foreign Application Priority Data

Jun. 15, 1978 [JP] Japan ..... 53-71445

[51] Int. Cl.[3] ..... C12P 19/34

[52] U.S. Cl. ..... 521/91; 164/43; 260/38; 260/39 R; 260/40 R; 264/337; 521/92; 521/122; 521/123; 521/139; 521/182

[58] Field of Search ..... 521/92, 91, 122, 123, 521/139, 182; 260/DIG. 40, 40 R, 38, 39 R, 42.16; 164/43; 264/337

[56] References Cited

U.S. PATENT DOCUMENTS

| | | | |
|---|---|---|---|
| 3,572,417 | 3/1971 | Wismer | 521/92 X |
| 3,574,646 | 4/1971 | Wismer et al. | 521/92 X |
| 3,993,117 | 11/1976 | Chenriot et al. | 260/DIG. 40 |
| 4,111,253 | 9/1978 | Epstein et al. | 260/DIG. 40 |

FOREIGN PATENT DOCUMENTS

| | | | |
|---|---|---|---|
| 2755910 | 7/1978 | Netherlands | 521/92 |

*Primary Examiner*—J. Ziegler

*Attorney, Agent, or Firm*—Schwartz, Jeffery, Schwaab, Mack, Blumenthal & Koch

[57] ABSTRACT

A binder composition for binding foundry sand particles to form molds and cores in sand mold casting processes which may be aluminum alloy casting processes, comprising a thermosetting resin and powdery zinc carbonate which is dispersed in the resin and, while the molds and cores are heated by the poured molten metal, undergoes thermal decomposition with generation of carbon dioxide gas which aids the molds and cores to become readily disintegratable.

4 Claims, 3 Drawing Figures

FIG. 2 (PHENOLIC RESIN)
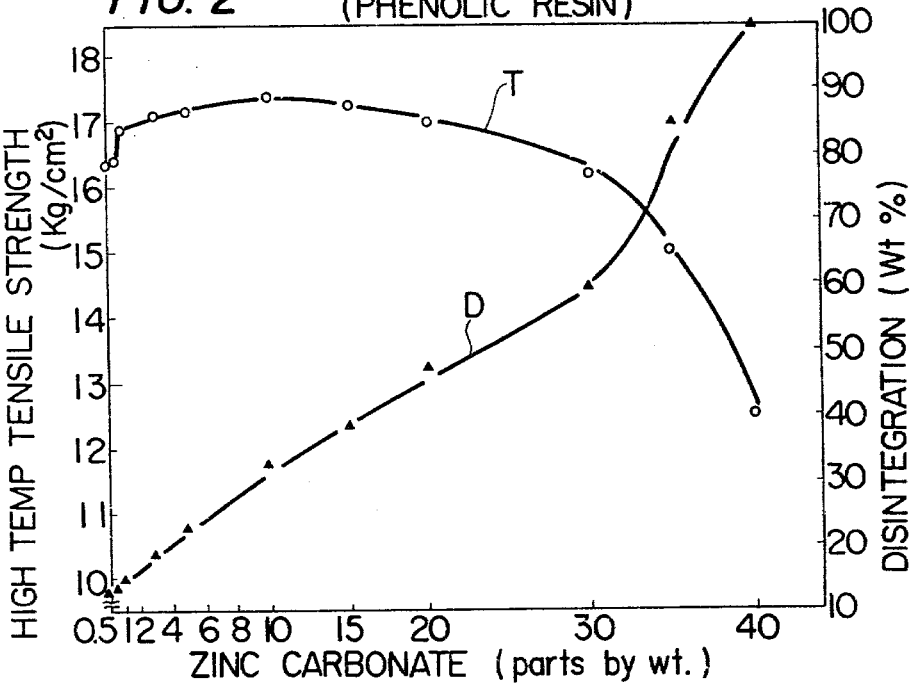
FIG. 3 (UNSATURATED POLYESTER RESIN)
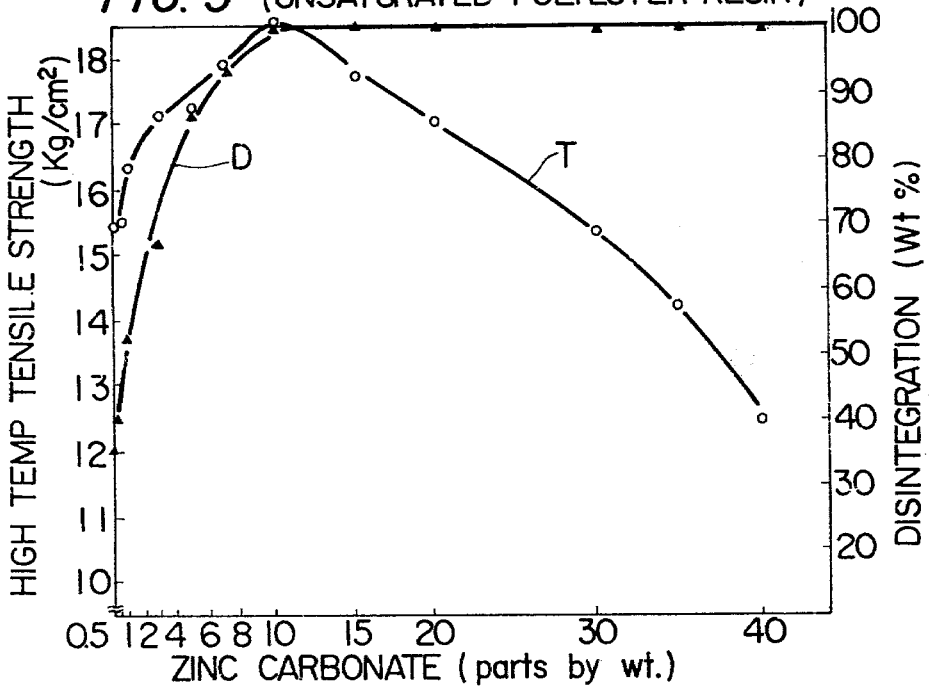

BINDER COMPOSITION FOR FOUNDRY SAND CONTAINING ZINC CARBONATE DISPERSED IN RESIN

BACKGROUND OF THE INVENTION

This invention relates to a binder composition for binding foundry sand particles at the forming of molds and cores for use in a sand mold casting process and a coated sand prepared by using the same binder composition.

In current sand mold casting processes, molds and cores are usually formed of a resin coated sand, that is, by the use of a binder of which principal component is a thermosetting resin typified by phenolic resin to bind or integrate foundry sand particles. In iron casting processes, molds and cores formed of a resin coated sand are generally satisfactory both in high temperature strength and ease of disintegration after solidification of the poured molten iron.

However, the situation is different in some alloy casting processes characterized by relatively low pouring temperatures as typified by alluminum alloy casting processes wherein pouring temperatures are in the range of about 650°–750° C. Due to lowness of the pouring temperature, molds and cores of a resin coated sand retain their toughness even at the stage of shake-out and offer difficulties in disintegrating them. This problem is particularly serious for cores. It is a usual practice, therefore, to facilitate disintegration of the cores by baking cores in the castings at 400°–500° C. for a period of time as long as 4–10 hr in advance of a shake-out operation. This is of course unfavorable to the efficiency and costs of the casting process.

A primary reason for significantly higher resistance of cores to disintegration compared with molds is that, because the cores surrounded by the molten alloy undergo heating without being supplied with oxygen, the thermosetting resin used for binding the sand particles does not sufficiently decompose but undergoes significant carbonization which is adversely effective for lowering of the physical strength of the sand cores. In iron casting processes the same thermosetting resin undergoes sufficient decomposition owing to higher pouring temperatures (1300°–1400° C.) such that even cores exhibit sufficient lowering of physical strength and become readily disintegratable.

For molds, the degree of disintegratability does not become a serious problem because molds can readily be broken by externally applying mechanical force thereto. For cores, however, lack of disintegratability becomes a serious disadvantage since cores in the castings cannot easily be broken by the exertion of an external force. Accordingly wide studies have been made on binders for making sand molds and cores readily disintegratable after a casting process, but a fully satisfactory binder for this purpose has not yet been provided.

For example, it has been proposed to add a certain compound, such as potassium nitrate or sodium nitrate, which undergoes thermal decomposition with liberation of oxygen to a phenoric resin, a popular binder, expecting that the liberated oxygen will promote combustion of the phenoric resin in the cores heated during casting operation. Actually, however, the additive according to this method did not produce a practically appreciable improvement in the disintegratability of cores of the resin coated sand, so that this proposal has not been put into industrial practice. Besides, this method has disadvantages such as the tendency of lowering in the initial strength of the molds and cores and the presence of potassium oxide or sodium oxide formed by the decomposition of the additive or a hydroxide formed by reaction of such an oxide with water in the waste sand, causing the waste sand to become strongly alkaline and therefore making it necessary to neutralize the waste sand in advance of its reuse or dumping.

Also it has been proposed to replace a traditional phenolic resin by a more suitable resin, and modified phenolic resins have been subjected to industrial trial. However, hitherto proposed methods of this category are still unsatisfactory in the extent of improvement in the disintegratability of sand cores. From the same viewpoint, the use of an isocyanate known as the Ashland process is also unsatisfactory.

SUMMARY OF THE INVENTION

It is an object of the present invention to provide an improved binder composition for binding foundry sand particles at the forming of molds and cores for use in sand mold casting processes, which binder composition can afford a sufficiently high initial strength to the molds and cores but, nevertheless, renders the molds and cores readily disintegratable after casting operation without yielding any harmful or foul-smelling substance.

It is another object of the invention to provide an improved coated sand which is obtained by coating conventional foundry sand particles with a binder composition according to the invention.

A binder composition according to the invention comprises a thermosetting resin and powdery zinc carbonate substantially uniformly dispersed in the resin, and the proportion of zinc carbonate to the thermosetting resin is in the range from 0.5:100 to 30:100 by weight.

The thermosetting resin in this binder composition can be selected from conventional ones exemplified by phenolic resins and unsaturated polyester resins, and it is preferable to select a thermosetting resin which begins to soften at a temperature not higher than 130° C.

A coated sand according to the invention comprises a major amount of a foundry sand and a minor amount of a binder composition which is one according to the invention as stated above and is in the form of coating on the individual particles of the foundry sand.

A binder composition according to the invention is characterized by the presence of a specified amount of zinc carbonate and fully satisfies various requirements to a binder composition for binding foundry sand particles to form molds and cores for use in a sand mold casting process, particularly the following important items.

(1) The molds and cores formed by using the binder composition should be sufficiently high in their initial strength.

(2) After solidification of the poured molten metal the molds and cores should be readily disintegratable simply by a mechanical shake-out operation even when the pouring temperature is relatively low as in the case of an aluminum alloy casting process.

(3) The waste sand produced by the shake-out operation should not contain any harmful or innocuous substance.

(4) The molds and cores heated during pouring operation and/or shortly thereafter should not emit an unwholesome or foul-smelling gas in a considerable volume.

If it is enough to give one's concern only to the disintegratability of molds and cores of a resin coated sand, it will be possible to obtain a suitable binder composition by using an organic compound which is comparable with zinc carbonate in decomposition temperature. However, such a binder composition has a drawback that the initial strength of the molds and cores lowers because of softening of the organic compound at elevated temperatures. Besides, most of organic compounds suitable for this purpose yield ammonia or other foul-smelling substances upon decomposition. Accordingly binder compositions containing an easily decomposable organic additive are unsuitable for industrial use.

Pure zinc carbonae $ZnCO_3$ decomposes at about 140° C., and the partial pressure of the decomposition gas becomes as high as about 760 mmHg at 300° C. Many inorganic compounds undergo thermal decomposition of which conditions are close to the decomposition conditions of pure zinc carbonate. However, we have determined to use a carbonate, i.e. an inorganic compound that undergoes thermal decomposition with generation of carbon dioxide gas, taking into consideration a requirement that the decomposition product (including a gas phase) of the disintegration-promoting additive be harmless and innocuous. For example, a metal acetate such as zinc acetate yields carbon dioxide gas when almost completely decomposed but is undesirable because of inevitable partial decomposition to liberate acetic acid which has an offensive smell. Furthermore, we have recognized that the above described four items of requirements to a binder composition cannot be met all be using any carbonate other than zinc carbonate as a disintegration-promoting additive. The use of a carbonate of a heavy metal often results in the presence of an oxide of a harmful heavy metal such as chromium or cadmium in the decomposition product and, therefore, offers troubles to the disposal of the waste sand. The use of a carbonate of either an alkali metal or an alkaline earth metal also offers troubles to the disposal of the waste sand because the decomposition product of such a carbonate contains a metal oxide that turns into a strongly alkaline hydroxide by absorption of moisture.

In the present invention, zinc carbonate is not limited to pure zinc carbonate $ZnCO_3$. It is permissible, and in practice it will be more convenient, to use basic zinc carbonate (zinc hydroxycarbonate) expressed by, for example, $2ZnCO_3.3Zn(OH)_2.H_2O$.

Sand molds, including cores, utilizing a binder composition according to the invention retain a sufficiently high mechanical strength during pouring operation but undergo a considerable lowering of their strength during solidification of the poured molten metal and consequentially become disintegratable to a sufficient extent. The reason for such effects of the present invention may be explained as follows.

In a mold (or core) of a coated sand, the surface of each sand particle is coated with a thin layer of a resinous binder which keeps each particle firmly adhered to the adjacent sand particles, so that the mold retains its shape. Accordingly the mechanical strength of the mold depends primarily on the physical properties of the binder. Where the binder consists of organic compounds as usual in conventional binders, the application of heat to the coated sand during the steps of mold forming and molten metal pouring causes the binder in the mold to soften considerably, resulting in that the sand particles in the mold become rather readily movable relative to each other and that the mold exhibits some lowering of its strength. In the case of a binder according to the invention, the particles of zinc carbonate (for example, particles having a mean particle size of about 1 μm) dispersed in the binder make a contribution to the resistance of the mold to a mechanical force while the resin in the binder is partially in a softened state, so that the heated mold retains a higher strength than a similarly heated mold which comprises a conventional binder. After completion of the pouring, the molten metal poured into the mold undergoes a gradual lowering of its temperature while the mold is heated by the molten metal. Since a sand mold is rather low in heat conductivity, the heat supplied from the molten metal to the mold during the pouring step is mostly absorbed in a thin surface region of the mold and does not appreciably conduct into the remaining part of the mold. During the pouring step, therefore, softening of the resin in the mold occurs only locally and very partially, so that the mold exhibits a mechanical strength sufficient for accomplishment of the pouring operation. As the temperature in the mold rises to the decomposition temperature of zinc carbonate during temperature lowering of the poured molten metal, the zinc carbonate contained in the binder decomposes to zinc oxide with generation of carbon dioxide gas, which causes cracking and consequential strength reduction of the aforementioned binder layer between the sand particles. Simultaneously the resin itself undergoes partial decomposition by the influence of heat and exhibits lowering of its binding ability. As the result, there occurs a considerable lowering of the strength of the mold while the molten metal undergoes cooling. Since the molten metal solidifies and acquires a sufficient strength before completion of the strength reduction process in the mold, the lowering of the mold strength does not influence the shape of the solidified molten metal or casting.

BRIEF DESCRIPTION OF THE DRAWINGS

FIG. 2 is a graph showing the influences of the amount of zinc carbonate in a phenolic resin binder composition on the initial strength and later disintegratability of a mold made of a coated sand prepared by the use of the binder composition; and FIG. 3 is a graph showing the same matter as FIG. 2 with respect to a binder composition comprising an unsaturated polyester resin.

DESCRIPTION OF THE PREFERRED EMBODIMENTS

Figure 1:
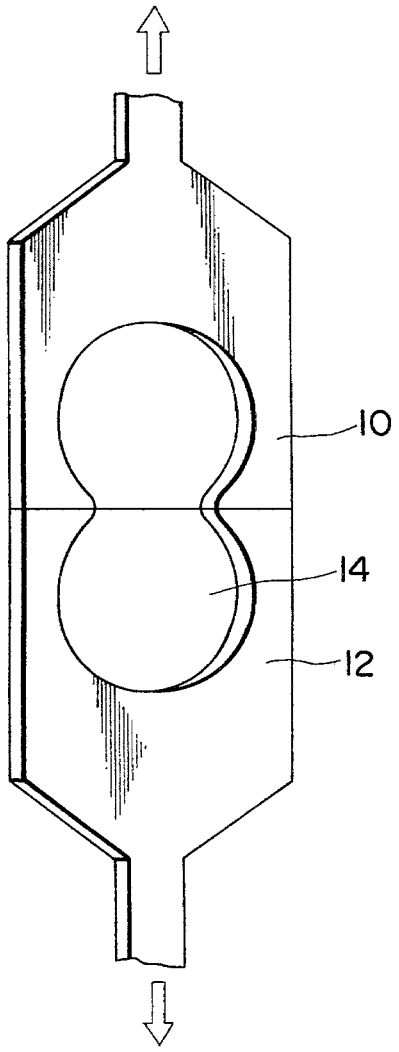
FIG. 1 is a perspective view of a device to make a tensile strength test for a resin coated sand.

Fundamentally a binder composition according to the invention is prepared by admixing powdered zinc carbonate with a thermosetting resin in a softened state. If the mixing is performed at a temperature above 140° C. the zinc carbonate will decompose during mixing operation. Accordingly it is preferable to use a thermosetting resin which begins to soften at a temperature not higher than 130° C. Besides, it is preferable that the resin is in a sufficiently solidified state in the temperature range from about 150° C. to about 330° C. and can be cured in a short time. In the present application, the statement that a thermosetting resin begins to soften at a certain temperature means that the resin begins to soften when the resin is heated to the mentioned temperature in a state not yet cured, that is, either in a state before the addition of a curing agent to the resin or in a state after the addition of a curing agent but before the occurrence of a considerable reaction between the resin and the curing agent. Sand molds and cores utilizing a binder composition according to the invention are formed at temperatures in the aforementioned range of about 150°-330° C. Since forming of the molds and cores does not take a long time, only a very small amount of the zinc carbonate contained in the binder decomposes at this stage, if any, so that no problem is offered to the mold-forming operation.

Examples of thermosetting resins having the above described properties and useful in the present invention are phenol-formaldehyde resins, urea-formaldehyde resins, alkyd resins and unsaturated polyester resins.

For example, a binder composition according to the invention is prepared in the following way. First a selected thermosetting resin is softened by heating (in the case of a phenolic resin, to about 120° C.) in a vessel equipped with a stirrer, and then a desired amount of powdered zinc carbonate is added to the softened resin. Optionally, additives usually employed in conventional binder compositions may also be added to the softened resin. Thereafter stirring is continued to accomplish uniform dispersion of the zinc carbonate powder and the additives, if any, in the softened resin. The resultant mixture is a binder composition according to the invention. Then the hot binder composition is cooled to allow the resin to completely solidify, and the solidified binder composition is crushed into a powdery form or a granular form.

Using a powdery or granular binder composition according to the invention, a resin coated sand according to the invention can be prepared generally similarly to the preparation of a conventional resin coated sand. For example, a preheated (e.g. to about 170° C.) silica sand useful as foundry sand is charged into a conventional speed mixer, and immediately the powdered or granular binder composition is added to the sand in the mixer. The heated sand and the binder are well mixed by continuing stirring. Thereafter, conventional additives such as, in the case of the binder comprising a phenolic resin by way of example, a catalyst such as an aqueous solution of hexamethylenetetramine and a fluidity-improving wax such as calcium stearate are added to the sand-binder mixture, and stirring is continued until lowering of the sand temperature below a temperature at which the thermosetting resin in the binder begins to soften. The product of this process is a resin coated sand according to the invention, viz. foundry sand particles coated with a binder composition according to the invention.

Alternatively, a resin coated sand according to the invention can be prepared by the following method, which may be taken as simultaneous accomplishment of the preparation of a binder composition and coating of sand particles with the binder composition. At first, a thermosetting resin is added with necessary additive(s) such as, in the case of an unsaturated polyester resin by way of example, a catalyst and a coupling agent by heating the resin to soften, mixing the additives with the softened resin, cooling the mixture to solidify and pulverizing (or granulating) the solidified mixture. Then a preheated (e.g. to about 170° C.) silica sand is charged into a conventional speed mixer, followed by the addition of the above treated resin. After mixing for 1-2 min, an intended amount of powdered zinc carbonate is added to the resin-sand mixture, and stirring is continued further. Then a fluidity-improving agent such as calcium stearate may be added. The process is completed and gives a resin coated sand by continuing stirring until lowering of the sand temperature below a temperature at which the thermosetting resin begins to soften.

Either of these two types of methods may optionally be employed irrespective of the type of the selected thermosetting resin.

Similarly to conventional resin coated sands, the proportion of the binder to the sand in the present invention is in the range from about 1:100 to about 7:100 by weight.

A sand mold utilizing a resin coated sand according to the invention can be formed by pouring the coated sand into a metal mold, which has been preheated to a temperature in the range from about 150° C. to about 330° C. depending on the kind of the thermosetting resin in the binder composition, and thereafter maintaining the temperature of the metal mold in a predetermined range within the range of 150°-300° C. for a period of about 10-180 seconds.

The invention will be illustrated by the following examples.

EXAMPLE 1

A commercially available phenolic resin of the novolak type (phenol-formaldehyde resin) was used in pulverized form. Charged into a speed mixer in operation was 4 kg of a commercially available silica sand (for foundry use) preheated to 170° C. Immediately thereafter, 92 g of the pulverized phenolic resin was added to the sand, with continued stirring. After the lapse of 1 min from the charging of the sand, 0.46 g of powdered zinc carbonate was added to the sand (0.5 parts by weight of zinc carbonate to 100 parts by weight of the phenolic resin), and, 30 sec thereafter, 13.8 g of hexamethylenetetramine in the form of 20% aqueous solution was added to the mixture in the mixer, with continued stirring. 30 sec later, viz. after the lapse of 2 min from the charging of the sand, 2.76 g of calcium stearate was put into the mixer, and stirring was continued until the sand temperature lowered below the softening temperature (lower boundary) of the phenolic resin and the sand assumed a dry state. It took 3 min to complete this mixing operation counting from the moment of charging of the preheated sand into the mixer.

Additionally seven batches of resin coated sand were prepared in the same manner except that zinc carbonate was added to the mixture of 4 kg of the sand and 92 g of the phenol resin in different quantities, that is, 0.92 g (1 part by weight to 100 parts by weight of the resin), 2.76 g (3 parts by weight), 4.6 g (5 parts by weight), 9.2 g (10 parts by weight), 13.8 g (15 parts by weight), 18.4 g (20 parts by weight) and 27.6 g (30 parts by weight), in the respective batches.

REFERENCE 1

Using the materials employed in Example 1 and by the process of Example 1 except for the amount of zinc carbonate, three batches of resin coated sand were prepared. The quantities of zinc carbonate in these three batches were 0 g, 32 g (35 parts by weight to 100 parts by weight of the resin) and 36.8 g (40 parts by weight), respectively, so that these three batches were all not in accordance with the present invention.

Tensile Strength Test

High temperature tensile strength test was made on the eight batches of resin coated sand prepared in Example 1 and the three batches of Reference 1 by the use of a standard tensile strength test machine of the Shell type.

The test machine had a device to form a "test piece". Referring to FIG. 1, this device had two identically shaped metal plates 10 and 12 abutting each other in a symmetrical arrangement with a hole 14 formed in these plates 10, 12 across the plane of abutment. This hole 14 was of a shape like a dumb-bell fundamentally given by slightly overlapping two identical circles. The diameter of the circles was 40 mm, and the width of the constricted middle of the hole 14 was 25 mm. The metal plates 10 and 12 had a thickness of 6 mm. The two plates 10 and 12 arranged as shown in FIG. 1 were placed on a flat bottom plate (not shown) with a heater wire embedded therein, and the hole 14 was manually filled with a just prepared resin coated sand sample. Then a flat lid plate (not shown) with a heater embedded therein was placed on the plates 10 and 12, and the heaters were kept energized to bake the resin coated sand in the hole 14 at 250° C. for 70 sec. Then the lid plate was removed, and high temperature tensile strength of the "test piece" in the hole 14 was tested by pulling the two plates 10 and 12 in the opposite directions, as indicated by arrows in FIG. 1, with a gradually increasing force until breaking of the test piece in the hole 14.

In FIG. 2, the curve T represents the results of this test on the samples of Example 1 and Reference 1.

Disintegratability Test

From each of the eleven kinds of coated sands prepared in Example 1 and Reference 1, a test piece of the shape of a 50×50 mm and 20 mm thick square plate was molded by pouring the coated sand into a metal mold preheated to 190° C. and thereafter maintaining the mold at 230° C. for 5 min. Each test piece was wrapped in a 125×170 mm wide aluminum foil and in this state subjected to a 500° C. heat treatment in a furnace for 20 min. After cooling to room temperature, the test piece was stripped of the aluminum foil. This heat treatment was corresponding to the practically most unfavorable heating condition for a core formed of a resin coated sand in regard of disintegratability of the core.

The disintegratability of the heat-treated test piece was examined by means of a ro-tap type sieving machine for use in the particle size distribution test specified in JIS Z 2602. Each test piece was disposed in a 4-mesh sieve (openings: 4.76 mm) mounted on the sieving machine, and a pan was placed beneath the 4-mesh sieve. In this state the sieving machine was operated for 4 min, and the disintegratability of the test piece was represented by the weight of the sand passed the 4-mesh sieve (fallen into the pan) in percent of the initial weight of the test piece. In FIG. 2, the curve D shows the results of this test for the eleven kinds of coated sands.

Table 1 presents the test results shown in FIG. 2 in exact figures.

TABLE 1

| Zinc Carbonate (parts by weight) | (Phenolic Resin) High Temperature Tensile Strength ($Kg/cm^2$) | Disintegration (Wt %) |
|---|---|---|
| 0 | 16.4 | 13.1 |
| 0.5 | 16.5 | 13.3 |
| 1.0 | 16.9 | 14.9 |
| 3.0 | 17.1 | 18.8 |
| 5.0 | 17.1 | 23.5 |
| 10.0 | 17.3 | 33.6 |
| 15.0 | 17.1 | 38.9 |
| 20.0 | 16.8 | 47.7 |
| 30.0 | 16.2 | 60.0 |
| 35.0 | 15.0 | 86.1 |
| 40.0 | 12.7 | 99.8 |

EXAMPLE 2

A commercially available unsaturated polyester resin (N-20 of Mitsui Toatsu Chemical) weighing 2.5 kg was softened by heating at 120° C., and 75 g of dicumyl peroxide as a catalyst and 75 g of a silane compound as a coupling agent were added to and mixed with the softened resin. The resultant resin composition was cooled and crushed into a powdery form.

A speed mixer charged with 6 kg of sand preheated to 200° C. was operated for 1.5 min to warm the inside of the mixer. Then the sand was discharged, and immediately 4 kg of silica sand (for foundry use) preheated to 180° C. was poured into the mixer kept in operation, immediatedly followed by the addition of 212 g of the powdered polyester resin composition (the net weight of the resin was 200 g). After 1 min stirring, 1 g of zinc carbonate powder (0.5 parts by weight to 100 parts by weight of the resin) was added to the sand-resin mixture in the mixer. Stirring was continued and, 2 min later, 6 g of calcium stearate was added. By continuing stirring for additional 30 sec (meaning the lapse of 3.5 min from the moment of charging of the foundry sand), the sand in the mixer assumed a dry appearance, so that the preparation of a resin coated sand according to the invention was completed.

Additionally eight batches of resin coated sand were prepared in the same manner except that zinc carbonate was added to the mixture of 4 kg of sand and 212 g of the resin composition (resin: 200 g) in different quantities, that is, 2 g (1 part by weight to 100 parts by weight of the resin), 6 g (3 parts by weight), 10 g (5 parts by weight), 14 g (7 parts by weight), 20 g (10 parts by weight), 30 g (15 parts by weight), 40 g (20 parts by weight) and 60 g (30 parts by weight), in the respective batches.

REFERENCE 2

Using the materials employed in Example 2 and by the process of Example 2 except for the amount of zinc carbonate, three batches of resin coated sand were prepared. The quantities of zinc carbonate in these three batches were 0 g, 70 g (35 parts by weight to 100 parts by weight of the resin) and 80 g (40 parts by weight), respectively, so that these three batches were all not in accordance with the present invention.

The twelve kinds of coated sands prepared in Example 2 and Reference 2 were subjected to the above described tensile strength test except that the baking of each sand sample in the device of FIG. 1 to form the "test piece" was performed at 190° C. for 90 sec. In FIG. 3, curve T represents the results of this test.

Furthermore, these twelve kinds of coated sands were subjected to the above described disintegratability test. The curve D of FIG. 3 represents the results of this test. Table 2 presents the test results shown in FIG. 3 in exact figures.

TABLE 2

| Zinc Carbonate (parts by weight) | (Unsaturated Polyester Resin) High Temperature Tensile Strength ($Kg/cm^2$) | Disintegration (Wt %) |
|---|---|---|
| 0 | 15.4 | 35.0 |
| 0.5 | 15.6 | 39.2 |
| 1.0 | 16.3 | 53.8 |
| 3.0 | 17.2 | 66.2 |
| 5.0 | 17.3 | 86.7 |
| 7.0 | 17.8 | 94.7 |
| 10.0 | 18.6 | 100.0 |
| 15.0 | 17.6 | 100.0 |
| 20.0 | 16.9 | 100.0 |
| 30.0 | 15.3 | 100.0 |
| 35.0 | 14.3 | 100.0 |
| 40.0 | 12.6 | 100.0 |

The test results presented in FIGS. 2 and 3 (and Tables 1 and 2) demonstrate that the disintegratability can be improved even by the addition of only 0.5 parts by weight of zinc carbonate to 100 parts by weight of a thermosetting resin and can greatly be improved by the addition of at least 1 part by weight of zinc carbonate and that the addition of 0.5–30 parts by weight of zinc carbonate to 100 parts by weight of the resin brings about an enhanced high temperature tensile strength compared with the use of same resin without the addition of zinc carbonate. Based on numerous experimental data including those shown in FIGS. 2 and 3, the amount of zinc carbonate in the present invention is specified to be in the range from 0.5 to 30 parts by weight to 100 parts of the thermosetting resin and is preferable to be in the range from 1 to 30 parts by weight.

In a core formed of a coated sand according to the invention, a somewhat larger quantity of gas is produced during a casting process than in a core formed of a coated sand not comprising zinc carbonate. However, the casting can easily be prevented from involving defects such as cavities or blows attributable to an augmented gas generation by the employment of a popular technique, that is, to form appropriate vent holes in the core. As a demonstration, there was no difference in quality between an aluminum alloy cylinder head for a 1.8-liter automotive internal combustion engine cast by the use of a core formed of a resin coated sand according to the invention and a similar cylinder head cast by the use of a core formed of a conventional resin coated sand. For the casting obtained by utilizing the present invention, the shake-out of the casting to disintegrate the core could be achieved by means of a conventional shake-out machine without preceded by baking of the core in the casting. The easiness and completeness of the shake-out were comparable to, or even better than, those in the case of using a conventional phenolic resin binder composition to form the core and baking the core in advance of the shake-out operation.

What is claimed is:

1. A foundry composition for forming molds and cores for use in a sand mold casting process, the foundry composition comprising:

100 parts by weight of a foundry sand; and from about 1 to about 7 parts by weight of a binder composition which is in the form of coating on the individual particles of said foundry sand and comprises a thermosetting resin and powdery zinc carbonate dispersed in said resin, the proportion of said zinc carbonate to said resin being in the range from 0.5:100 to 30:100 by weight.

2. A foundry composition according to claim 1, wherein said thermosetting resin is a resin which begins to soften at a temperature not higher than 130° C.

3. A foundry composition according to claim 2, wherein said thermosetting resin is selected from the group consisting of phenolic resins, urea resins, alkyd resins and unsaturated polyester resins.

4. A foundry composition according to claim 3, wherein the proportion of said zinc carbonate to said thermosetting resin is in the range from 1:100 to 30:100 by weight.

* * * * *